US006869219B1

(12) United States Patent
Sala

(10) Patent No.: US 6,869,219 B1
(45) Date of Patent: Mar. 22, 2005

(54) SHOE-STORING SADDLEBAG ASSEMBLY

(76) Inventor: Michael P. Sala, 110 Radcliff Rd., Staten Island, NY (US) 10305

( * ) Notice: Subject to any disclaimer, the term of this patent is extended or adjusted under 35 U.S.C. 154(b) by 84 days.

(21) Appl. No.: 10/251,057

(22) Filed: Sep. 23, 2002

(51) Int. Cl.[7] ..... A45C 3/12

(52) U.S. Cl. ..... 383/37; 383/117; 150/111; 190/102; 190/108; 224/650; 224/652

(58) Field of Search ..... 150/111; 190/108, 190/102; 383/37, 117; 224/650, 652

(56) References Cited

U.S. PATENT DOCUMENTS

| | | | | | |
|---|---|---|---|---|---|
| 2,672,263 | A | * | 3/1954 | Alber | 224/602 |
| 3,143,153 | A | * | 8/1964 | Smith | 383/22 |
| 3,837,447 | A | * | 9/1974 | Honan | 190/110 |
| 4,424,841 | A | * | 1/1984 | Smith | 224/240 |
| 4,491,258 | A | * | 1/1985 | Jones | 224/153 |
| 4,746,159 | A | * | 5/1988 | Webb et al. | 294/147 |
| 4,884,731 | A | * | 12/1989 | Sibley | 224/651 |
| D311,093 | S | * | 10/1990 | Hoffman | D3/231 |
| 5,129,560 | A | * | 7/1992 | Herman | 224/579 |
| 5,219,423 | A | * | 6/1993 | Kamaya | 224/583 |
| 5,497,922 | A | * | 3/1996 | Tate | 224/647 |
| 5,513,787 | A | * | 5/1996 | Reed | 224/602 |
| 5,520,462 | A | * | 5/1996 | Clark | 383/37 |
| 5,540,364 | A | * | 7/1996 | Krieger et al. | 224/153 |
| 5,630,536 | A | * | 5/1997 | Bugnaski | 224/600 |
| 5,765,733 | A | * | 6/1998 | Brule | 224/153 |
| 5,806,740 | A | * | 9/1998 | Carlson | 224/628 |
| 5,873,504 | A | * | 2/1999 | Farmer | 224/576 |
| 5,881,708 | A | * | 3/1999 | Kliot | 224/653 |
| 5,927,575 | A | * | 7/1999 | Gatling | 224/153 |
| 5,947,241 | A | * | 9/1999 | Rausch | 190/108 |
| 6,012,557 | A | * | 1/2000 | Derelanko | 190/108 |
| D429,391 | S | * | 8/2000 | Grady et al. | D30/152 |
| 6,109,402 | A | * | 8/2000 | Godshaw et al. | 190/108 |
| 6,186,662 | B1 | * | 2/2001 | Jackson | 383/16 |
| 6,230,771 | B1 | * | 5/2001 | Hellenbrand | 150/111 |
| 6,269,991 | B1 | * | 8/2001 | Hood et al. | 224/258 |
| 6,651,853 | B2 | * | 11/2003 | Higgins et al. | 224/155 |
| 2002/0053583 | A1 | * | 5/2002 | Aldrich | |
| 2002/0179664 | A1 | * | 12/2002 | Worden, IV et al. | |

FOREIGN PATENT DOCUMENTS

| | | | | | |
|---|---|---|---|---|---|
| DE | 3323763 | A1 | * | 1/1985 | A45F/3/04 |
| JP | 2002136319 | A | * | 5/2002 | A45C/3/00 |

* cited by examiner

*Primary Examiner*—Sue A. Weaver

(57) ABSTRACT

A shoe-storing saddlebag assembly for carrying and storing shoes. The shoe-storing saddlebag assembly includes strap members being adapted to be extended and fastened about a backpack; and further includes slack-adjustable straps also being adapted to be extended about the backpack; and also includes fastening members for fastening the strap members about the backpack; further includes saddlebag members being attached to the strap members and to the slack-adjustable straps and being adapted to be draped upon the backpack for carrying and storing shoes.

3 Claims, 3 Drawing Sheets

SHOE-STORING SADDLEBAG ASSEMBLY

BACKGROUND OF THE INVENTION

1. Field of the Invention

The present invention relates to shoe-storing saddlebags and more particularly pertains to a new shoe-storing saddlebag assembly for carrying and storing shoes.

2. Description of the Prior Art

The use of shoe-storing saddlebags is known in the prior art. More specifically, shoe-storing saddlebags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,083,483; U.S. Pat. No. 1,909,942; U.S. Pat. No. 3,327,924; U.S. Pat. No. 5,431,265; U.S. Pat. No. Des. 328,670; and U.S. Pat. No. Des. 291,844.

While these devices fulfill their respective, particular objectives and requirements, the aforementioned patents do not disclose a new shoe-storing saddlebag assembly. The prior art includes bags designed to hold and carry shoes therein.

SUMMARY OF THE INVENTION

The general purpose of the present invention, which will be described subsequently in greater detail, is to provide a new shoe-storing saddlebag assembly which has many of the advantages of the shoe-storing saddlebags mentioned heretofore and many novel features that result in a new shoe-storing saddlebag assembly which is not anticipated, rendered obvious, suggested, or even implied by any of the prior art shoe-storing saddlebags, either alone or in any combination thereof. The present invention includes strap members being adapted to be extended and fastened about a backpack; and further includes slack-adjustable straps also being adapted to be extended about the backpack; and also includes fastening members for fastening the strap members about the backpack; further includes saddlebag members being attached to the strap members and to the slack-adjustable straps and being adapted to be draped upon the backpack for carrying and storing shoes. None of the prior art describes saddlebag members which are draped over a backpack.

There has thus been outlined, rather broadly, the more important features of the shoe-storing saddlebag assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new shoe-storing saddlebag assembly which has many of the advantages of the shoe-storing saddlebags mentioned heretofore and many novel features that result in a new shoe-storing saddlebag assembly which is not anticipated, rendered obvious, suggested, or even implied by any of the prior art shoe-storing saddlebags, either alone or in any combination thereof.

Still another object of the present invention is to provide a new shoe-storing saddlebag assembly for carrying and storing shoes.

Still yet another object of the present invention is to provide a new shoe-storing saddlebag assembly that is easy and convenient to use.

Even still another object of the present invention is to provides the user with additional room in the backpack and also separates the shoes from the clean clothes in the backpack.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
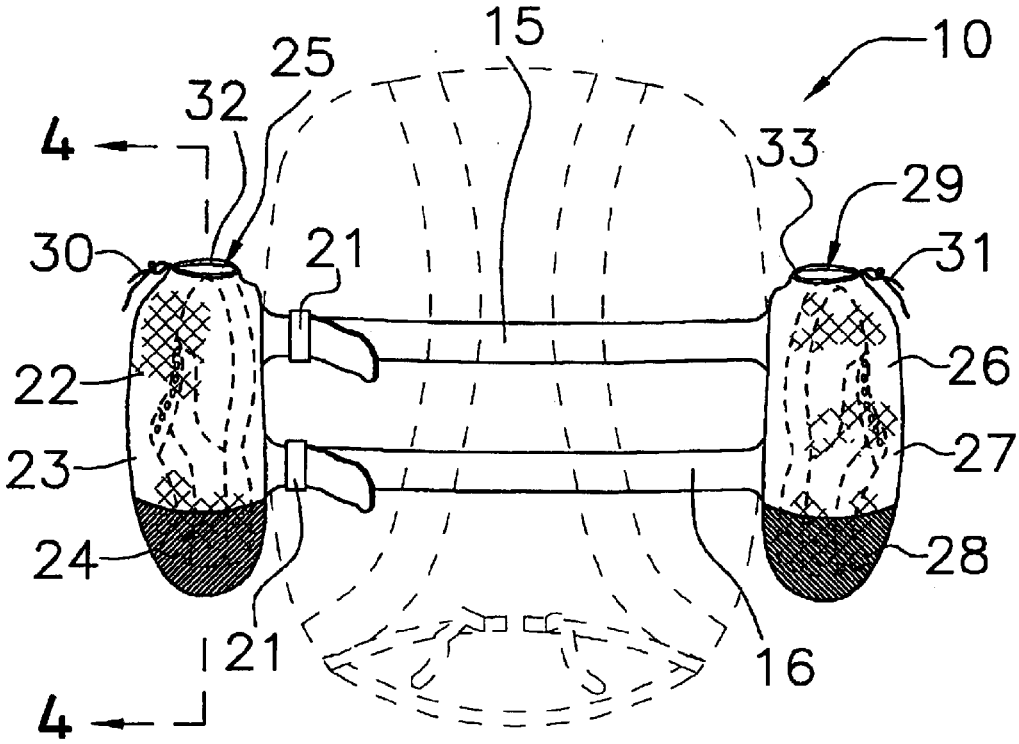
FIG. 1 is a perspective view of a new shoe-storing saddlebag assembly according to the present invention.
Figure 2:
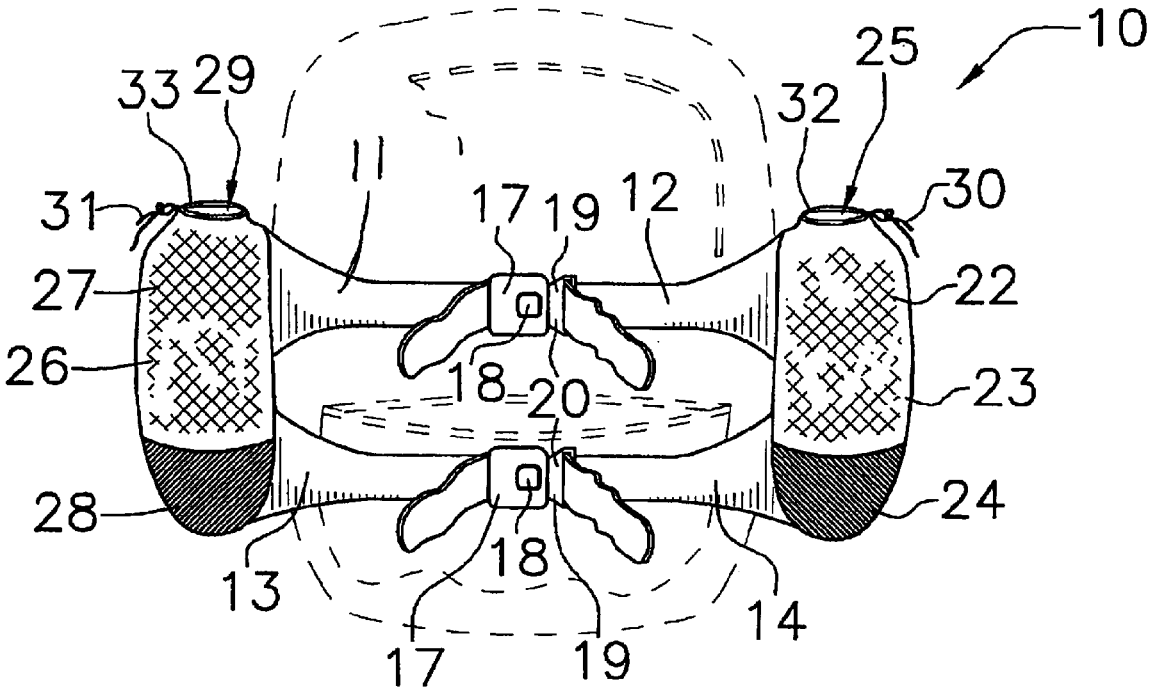
FIG. 2 is an elevational view of the present invention.
Figure 3:
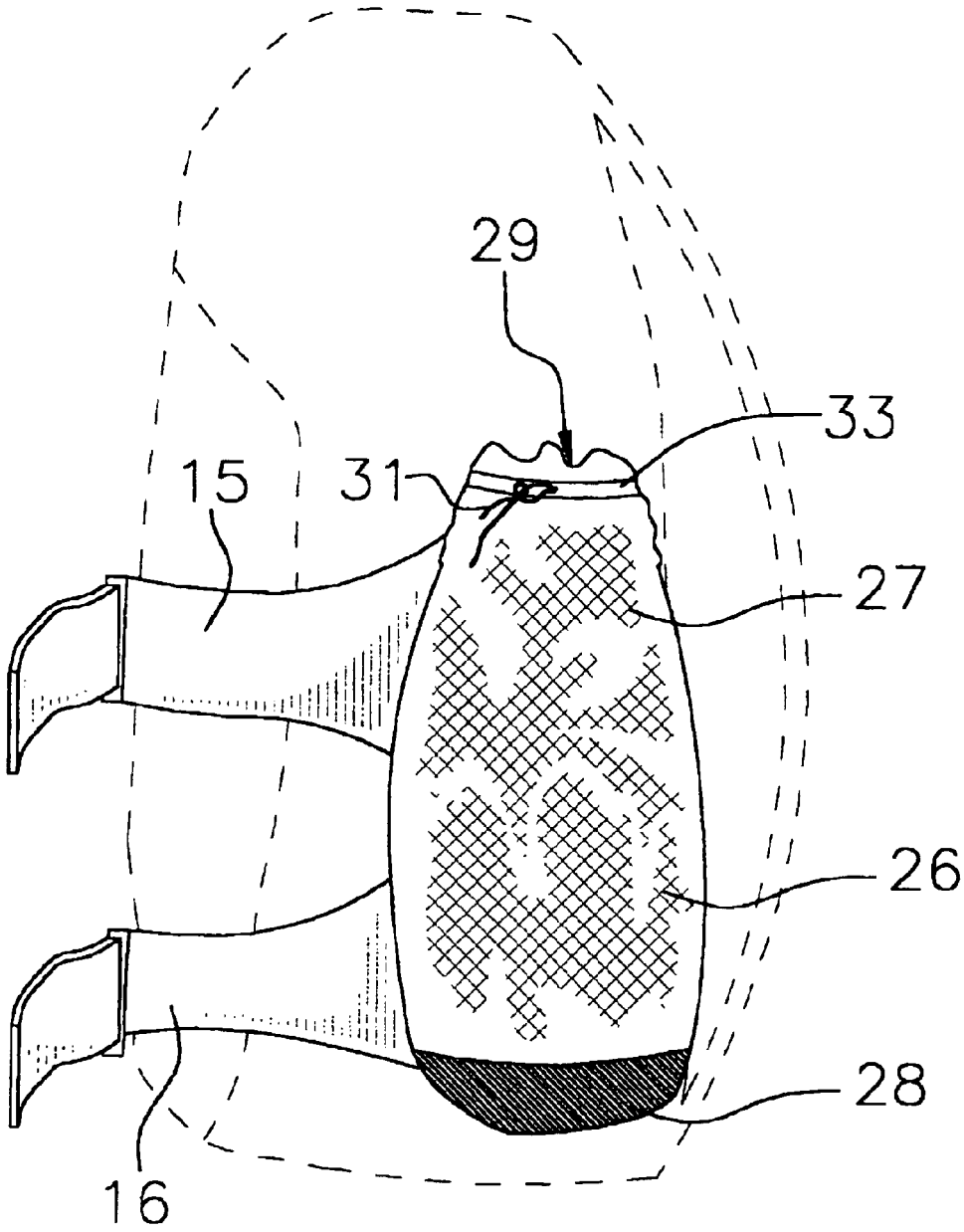
FIG. 3 is an end elevational view of the present invention.
Figure 4:
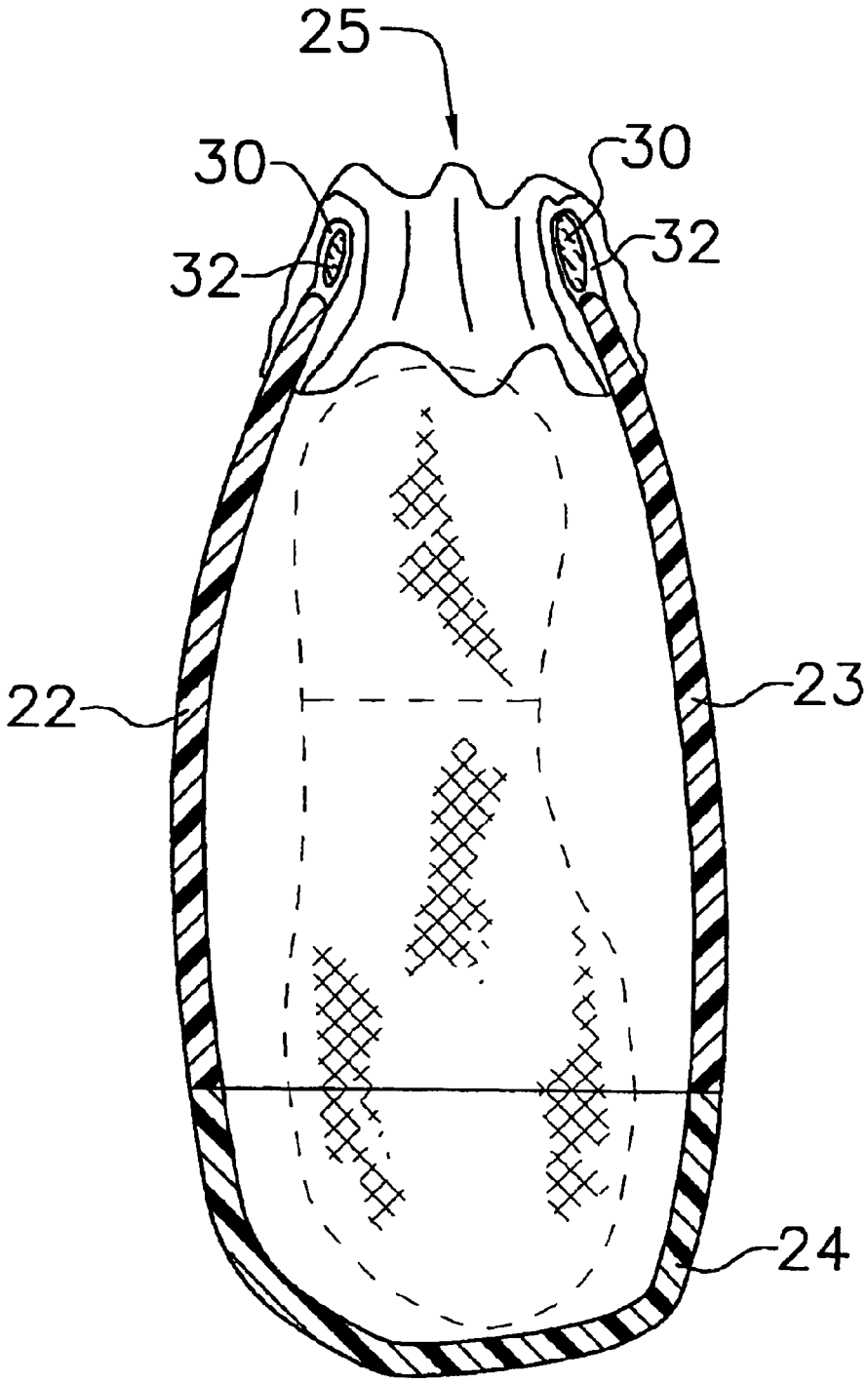
FIG. 4 is a cross-sectional view of the present invention.

With reference now to the drawings, and in particular to FIGS. 1 through 4 thereof, a new shoe-storing saddlebag assembly embodying the principles and concepts of the present invention and generally designated by the reference numeral 10 will be described.

As best illustrated in FIGS. 1 through 4, the shoe-storing saddlebag assembly 10 generally comprises strap members 11–14 being adapted to be extended and fastened about a backpack and also comprises slack-adjustable straps 15,16 being extended about the backpack. The strap members 11–16 include first and second straps 11,12 being fastenable to one another about the backpack, and also include third and fourth straps 13,14 being fastenable to one another about the backpack.

Fastening members 17–21 for fastening the strap members 11–14 about the backpack include female catches 17 having latch release buttons 18 and being conventionally attached to first ends of the first and third straps 11,13, and also include male latches 19 having loop portions 20 with the second and fourth straps 12,14 being adjustably looped through the loop portions 20, and being detachably and conventionally connected to and received in the female catches 16 17, and further include loop members 21 being disposed about the slack-adjustable straps 15,16.

Saddlebag members are conventionally attached to the strap members 11–14 and to the slack-adjustable straps 15,16 and are adapted to be draped upon the backpack for carrying and storing shoes. The saddlebag members are attached and sewn to second ends of the strap members 11–14 and to the slack-adjustable straps 15,16. Each of the saddlebag members includes a bag 22,26 having a mesh upper portion 23,27 and a polyester bottom closed-end portion 24,28 and being conventionally attached and sewn to the strap members 11–14 and to the slack-adjustable straps 15,16 and having an opening 25,29 therein, and also having an elastic band 30,31 being disposed along an edge defining the opening 25,29 for closing the opening 25,29. The bag 22,26 has an endless looped/tubular portion 32,33 extending along the edge defining the opening 25,29. The elastic bands 30,32 are disposed in the endless looped/tubular portion 32,33.

In use the strap members 11–14 are adjustably fastened about a backpack with the saddlebag members being draped along either side of the backpack, and the user places shoes in the openings 25,29 of the bags 22,26 with the elastic bands 30,31 closing the openings 25,29 to prevent the shoes from falling out of the bags 22,26 while the user carries the backpack.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the shoe-storing saddlebag assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe-storing saddlebag assembly comprising:

strap members being extended and fastened about a backpack, said strap members including first and second straps being fastenable to one another about the backpack, and further including third and forth straps being fastenable to one another about the backpack;

slack-adjustable straps also being extended about the backpack;

fastening members for fastening said strap members about the backpack, said fastening members including female catches having latch release buttons and being attached to first ends of said first and third straps; and also including male latches having loop portions through which said second and fourth straps are adjustably extended, and being detachably connected to and received in said female catches; and further including loop members being disposed about said slack-adjustable straps; and saddlebag members being attached to said strap members and to said slack-adjustable straps and being draped upon the backpack for carrying and storing shoes, said saddlebag members being attached to second ends of said strap members and to said slack-adjustable straps, each of said saddlebag members including a bag having an upper mesh portion and a closed-end polyester bottom portion and being attached to said strap members and to said slack-adjustable straps, and having an opening therein, and also having an elastic band being disposed along an edge defining said opening for closing said opening.

2. A shoe-storing saddlebag assembly as described in claim 1, wherein said bag has a looped/tubular portion extending along said edge defining said opening.

3. A shoe-storing saddlebag assembly as described in claim 2, wherein said elastic band is disposed in said looped/tubular portion.

* * * * *